United States Patent [19]

Tanaka et al.

[11] 4,040,405

[45] Aug. 9, 1977

[54] FUEL INJECTION SYSTEM FOR INTERNAL COMBUSTION ENGINE

[75] Inventors: Eizi Tanaka, Anjo; Hiroshi Mochizuki; Tooru Kosuda, both of Okazaki; Seikou Abe, Nishio; Michihiro Ohashi, Handa, all of Japan

[73] Assignee: Nippon Soken, Inc., Nishio, Japan

[21] Appl. No.: 693,951

[22] Filed: June 8, 1976

[30] Foreign Application Priority Data

June 10, 1975 Japan ..... 50-70292
July 4, 1975 Japan ..... 50-83049

[51] Int. Cl.[2] ..... F02M 69/00

[52] U.S. Cl. ..... 123/139 BG; 123/139 AW; 123/139 BC; 261/50 A

[58] Field of Search ..... 123/139 BC, 139 AW, 123/140 MP, 139 BG, 119 R; 261/50 A

[56] References Cited

U.S. PATENT DOCUMENTS

| | | | |
|---|---|---|---|
| 2,955,583 | 10/1960 | Dahl et al. | 123/139 AW |
| 3,029,800 | 4/1962 | Armstrong | 123/139 AW |
| 3,628,515 | 12/1971 | Knapp et al. | 123/139 AW |
| 3,996,910 | 12/1976 | Noguchi et al. | 123/139 AW |

*Primary Examiner*—Carroll B. Dority, Jr.
*Assistant Examiner*—Tony M. Argenbright
*Attorney, Agent, or Firm*—Cushman, Darby & Cushman

[57] ABSTRACT

In a fuel injection system for an internal combustion engine, a fuel pressure control device controls the pressure of fuel delivered and branched from a fuel delivery system in response to the flow rate of an intake air flowing through the control device, and the fuel with: the controlled pressure is delivered to a fuel metering device, which is driven in synchronism with the engine, so that the quantity of the fuel to be injected and charged into each of the cylinders of the engine may be varied in linear relation with the quantity of the intake air inducted into the engine.

10 Claims, 6 Drawing Figures

FUEL INJECTION SYSTEM FOR INTERNAL COMBUSTION ENGINE

BACKGROUND OF THE INVENTION

The present invention relates to a system for injecting a fuel, especially gasoline, into an internal combustion engine and more particularly a fuel injection system for an internal combustion engine, which controls the quantity of the fuel to be injected into the engine so that the quantity of the fuel may vary in linear relation with the variation of the quantity of an intake air induced into the engine.

There have been deviced and demonstrated many types of fuel injection systems for internal combustion engines. One type is provided with fuel metering device for metering the continuously flowing fuel, depending upon the quantity of air inducted into the engine, and the metered fuel is continuously injected through fuel injection nozzles attached to the intake pipe or duct of the engine. In the fuel metering device, a variable orifice is located in a fuel passage and operatively coupled to a sensor for detecting the intake air flow rate or the quantity of the intake air inducted into the engine. In addition, the fuel metering device includes a differential pressure regulating valve so that the differential pressure across the variable orifice may be maintained at a predetermined level. Therefore, the variable orifice controls the flow rate of the fuel which continuously flows through the fuel passage.

In another type, the fuel is metered by a Jerk type fuel injection pump provided with a solid cam control device which is actuated in response to the rotational speed of the engine and depending upon the degree of opening of a throttle valve, whereby the air-fuel ratio is controlled. The metered fuel is intermittently injected through a fuel injection nozzle into each cylinder of the engine.

In the former type described above, the intake air passage has a very complex configuration so that the quantity of intake air may be in proportion to the angular displacement of the shaft of the sensor which in turn causes the displacement of a piston or plunger type valve member of the fuel control device. Furthermore, in order to reciprocate the plunger to which the pressure of the fuel is exerted, the sensor must generate the pressure higher than the pressure of the fuel acting upon the plunger. Therefore, the sensor is, in general, large in size and complicated in construction.

More particularly, the plunger of the fuel metering device is operatively coupled to a supporting arm connected to a sensor valve or vane in such a way that the supporting arm acts as a lever on the plunger increasing the force acting on the lower end of the plunger to overcome the pressure of the fuel acting upon the upper end of the plunger. Therefore, in order to increase the driving force applied to the plunger, the size of the sensor valve or vane must be increased so that the area upon which the air pressure acts may be increased. Further, the lever or supporting arm must be increased in size so that the increased force may be applied to the plunger. Therefore, the intake air sensor becomes large in size and complicated in construction. The intake air sensor of the type described presents another problem that the distance between the intake air sensor and the fuel metering device is limited because the plunger of the latter is coupled to the supporting arm of the former through the mechanical linkage so that the intake air sensor and the fuel metering device cannot be mounted in their respective suitable positions.

In the fuel injection system of the type using a Jerk type fuel pump, there is an advantage in that the fuel may be injected under a high pressure so that the satisfactory atomization of the fuel may be attained. However, the quantity of the fuel to be injected is controlled in response to the rotational speed of the engine and to the degree of opening of a throttle valve. That is, the quantity of the fuel is not controlled directly depending upon the quantity of the intake air inducted into the engine. As the result, the quantity of the fuel to be injected is not corrected or compensated even when the quantity of the intake air varies due to the wear of the engine and the variation in accuracy accompanied with the assemble parts. Consequently, the air-fuel ratio cannot be controlled with a desired degree of accuracy. In addition, in case of a multi-cylinder engine, the Jerk type pumps equal in number to the cylinders must be provided so that the fuel injection system is very complex in construction. Furthermore, this system includes a large number of parts which must be machined and finished with a higher degree of accuracy so that the manufacturing cost is high. Moreover the Jerk type fuel injection pumps are large in size and heavy in weight so that it is extremely difficult to mount them on a vehicle.

In view of the above, according to the present invention a fuel injection system comprises the fuel pressure control device for detecting the intake air flow rate or the quantity of the intake air inducted into the engine and for controlling the fuel pressure in response to the intake air flow rate and fuel metering device which meters the fuel in response to the operation of the fuel pressure control device, said fuel metering device having a control shaft which is operatively and hydraulically coupled to the fuel pressure control device. To the end of the present invention therefore, there is provided a fuel injection system which very simple in construction and compact in side and which can intermittently deliver the fuel accurately in proportion to the quantity of the intake air to be inducted into the engine.

Another object of the present invention is to provide a fuel pressure control device which is very simple in construction and compact in size.

A further object of the present invention is to provide a fuel metering device which may be easily mounted on the engine.

Accordingly to one preferred embodiment of the present invention, the fuel pressure control device includes a control orifice which is defined by a circumferentially partially extended parallel slit formed on the inner surface of a cylindrical bearing and a cutout portion of a sensor valve shift fitted into the bearing so that the opening of the control orifice may be varied depending upon the quantity of intake air, thereby controlling the quantity of the fuel to be injected. A fuel differential pressure regulating valve is provided in order to maintain the differential pressure across the control orifice at a predetermined level, and the parallel slit is formed in parallel with the surface of the cutout portion of the sensor valve shaft. Therefore, the quantity of the fuel flowing through the control orifice varies in linear relation with the quantity of the intake air.

Since there is a fixed orifice for limiting the flow rate of the fuel at the upstream of the control orifice, the fuel changes in pressure in proportion to the square of the opening area of the control orifice. The opening area of the control orifice changes as a function of $\sin^2(\theta/2)$, where $\theta$ is the angle of rotation of the sensor valve shaft. Therefore, the pressure of the fuel varies as a function of $\sin^2(\theta/2)$.

The area of the opening defined between the sensor valve and the air duct in the fuel pressure control device changes as a function of the angle of rotation $\theta$ of the sensor valve shaft. When the air duct is rectangular in cross section, the opening area varies approximately as a function of $\sin^2(\theta/2)$. When the cross section of the air duct is so compensated that the opening area may be varied precisely as a function of $\sin^2(\theta/2)$, and since there may be provided an intake air differential pressure regulating valve which may maintain the differential pressure across the sensor valve at a predetermined level, the intake air flow rate or the quantity of intake air varies as a function of $\sin^2(\theta/2)$.

From the above relation, it is naturally resulted that the fuel pressure varies with the intake air flow rate or the quantity of intake air in the ratio of 1:1.

When the pressure of the fuel is applied to the control shaft of the fuel metering device, the displacement of the control shaft changes with the pressure of the fuel at the constant ratio of 1:1. Since the pressure of the fuel changes as a function of $\sin^2(\theta/2)$ while the quantity of intake air changes also as a function of $\sin^2(\theta/2)$, the displacement of the control shaft changes in linear proportion to the quantity of intake air.

For the sensor valve which may satisfy the above relations, it is only necessary to operate to overcome against its return spring. Thus a sensor valve or vane small in size may be used in practice. As a result, the fuel pressure control device can be made compact in size.

The displacement of the control shaft of the fuel metering device is effected by the pressure of the fuel so that the fuel metering device may be hydraulically communicated with the fuel pressure control device through a pipe line or the like. Therefore, the fuel metering device is possible to be mounted in any suitable position so that its mountability is improved.

Since the supplying pressure of the fuel to the internal combustion engine is used as the operating pressure for the control shaft of the fuel metering device, no special hydraulic circuit is required for delivering the hydraulic pressure to drive the control shaft.

The above and other objects, features and advantages of the present invention will become more apparent from the following description of the preferred embodiments thereof taken in conjunction with the accompanied drawings.

DESCRIPTION OF THE PREFERRED EMBODIMENTS

First Embodiment, FIGS. 1 through 5

Figure 2:
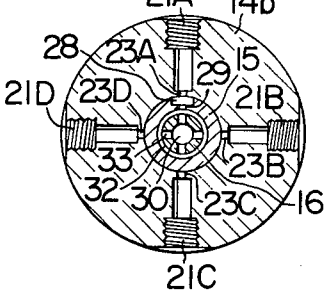
FIG. 2 is a cross sectional view taken along the line II—II of FIG. 1.
Figure 1:
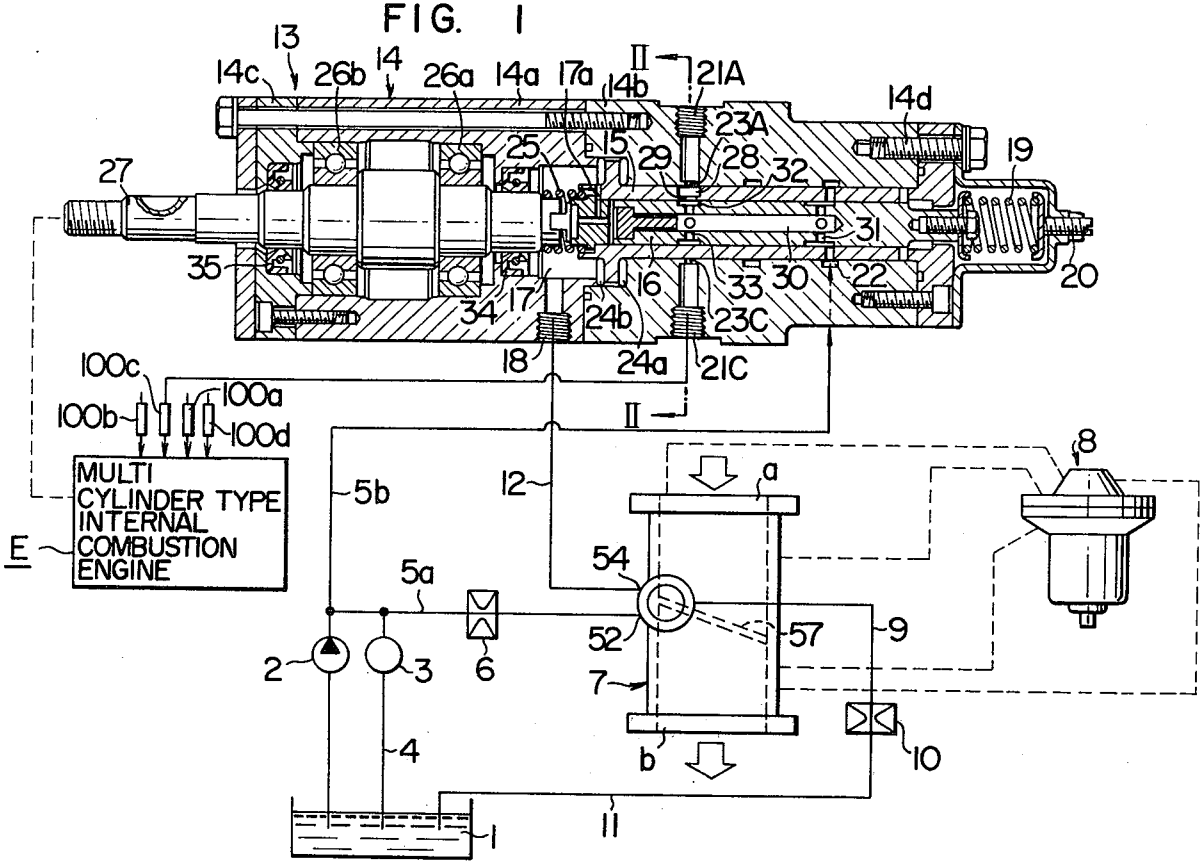
FIG. 1 is a block diagram of a first embodiment of the present invention with a fuel metering device being shown in cross section.

Referring first to FIGS. 1 and 2, reference numeral 1 denotes a fuel tank; 2, a fuel pump for delivering the fuel to a fuel pressure control device 7 through a fuel line 5*a* in which a restrictor orifice 6 is provided, and to a fuel metering device 13 through a fuel line 5*b*. The fuel pressure control device 7 effects the hydraulic pressure control as will be described in detail herein-after. Further, 3 denotes a pressure regulator; 4, a return line for returning the excess fuel from the regulator 3 to the fuel tank 1; 8, a differential pressure regulator which maintains the pressure difference across a sensor valve 57 as will be described in more detail hereinafter; 9 and 11, return lines for returning the excess fuel to the fuel tank 1 through a restrictor orifice 10 from the fuel pressure control device 7; and 12, a fuel line for delivering the fuel from the control device 7 to the fuel metering device 13.

In the metering device 13, reference numeral 14 denotes a housing made of wear-resistant steel Cr-Mo; 15, a cylindrical rotor rotatably inserted into the housing 14; 16, a control shaft smoothly slidably and fluid-tightly fitted into the rotor 15; 17, a pressure chamber; 17*a*, a passage through which the pressure in the pressure chamber 17 is transmitted to one end of the control shaft 16; 18, a hydraulic pressure admitting port intercommunicating between the fuel line 12 and the pressure chamber 17; 19, a return spring; and 20, an adjusting screw for presetting the force of the return spring 19. Said rotor 15 and said control shaft 16 are also made of wear-resistant steel Cr-Mo.

The housing 14 consists of first and second main body blocks 14*a* and 14*b*, a right cover 14*d* and a left cover 14*c*, all of which are assembled into a unitary construction with bolts. The second main body block 14*b* has a radially extending fuel intake port (not shown) connected to the fuel line 5*b* and four radial fuel discharge ports 21A, 21B, 21C and 21D (See FIG. 2) which are circumferentially equiangularly spaced apart from each other and are communicated with fuel intake ports 23A, 23B, 23C and 23D, respectively. The second main body block 14*b* further has an annular groove 22 formed in the inner surface thereof and in communication with the radially extending fuel intake port.

The rotor 15 is rotatably supported by bearings 24*a* and 24*b* and loaded with a coiled spring 25 at the left in such a way that the rotor 15 may be permitted to rotate but may not permitted to be displaced within the housing 14 in the axial direction thereof. The rotor 15 is coupled to a drive shaft 27 made of Cr-Mo steel and rotatably supported by two bearings 26*a* and 26*b* in the first main body block 14*a*. The rotor 15 is rotated in synchronism with the crankshaft (not shown) of an internal combustion engine E through the drive shaft. In case the engine E is of the four-cylinder, four-cycle, reciprocating type, the rotation ratio between the crankshaft of the engine E and the rotor 15 is so selected that the rotor 15 makes one rotation for every two rotations of the crankshaft, and the crankshaft is drivingly coupled to the rotor 15 through suitable means such as gears, a chain or belt. The rotor 15 has one distribution chamber 28 formed in the outer surface thereof at the same axial position as those of the fuel discharge ports 21A, 21B, 21C and 21D (which are communicated respectively with intake ports 23A, 23B, 23C and 23D) of the housing 14. The rotor 15 further includes a radial slit 29 formed therethrough and communicated with the distribution chamber 28. As the rotor 15 rotates, the distribution chamber 28 is sequentially communicated with the fuel intake ports 23A, 23B, 23C and 23D of the housing 14.

The control shaft 16 is fitted into the rotor 15 in such a way that it is permitted to be displaced in the axial direction but is not permitted to rotate with the rotor 15. The hydraulic pressure in the pressure chamber 17 is transmitted through the passage 17*a* to the left end face of the control shaft 16 so that the control shaft 16 is displaced to an equilibrium position where a force excerted by the hydraulic pressure transmitted from the fuel pressure control device 7 through the line 12 is in equilibrium with the compressed force of the spring 19. The control shaft 16 has an axially extended fuel passage 30 and a radial fuel intake port 31 in communication with the annular groove 22 which in turn is communicated with the radially extending fuel intake ports of the housing 14. The control shaft 16 further includes an annular groove 32 in communication with the slit 29 of the rotor 15. This annular groove 32 is communicated with the axially extended fuel passage 30 through a fuel discharge port 33. Since the control shaft 16 is axially displaceable, the fuel flow from the annular groove 32 of the control shaft to the slit 29 of the rotor 15 is metered or varied. In other words, an opening area between the annular groove 32 and the slit 29 is variable with the displacement of the control shaft 16. The opening area will be referred to as "a passage area". The fuel discharge ports 21A, 21B, 21C and 21D of the housing 14 are communicated with respective fuel injection nozzles 100*a,* 100*b,* 100*c* and 100*d* which are respectively provided for the intake manifold of the engine E. Reference numerals 34 and 35 denote sealing members.

Figure 3:
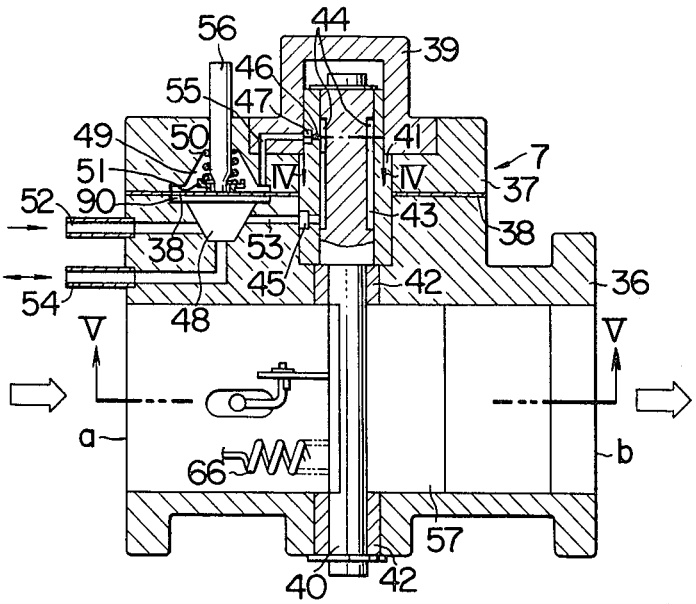
FIG. 3 is a longitudinal cross sectional view of a fuel pressure control device.
Figure 4:
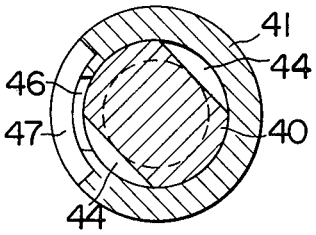
FIG. 4 is a cross sectional view, on enlarged scale, taken along the line IV—IV of FIG. 4.

Fuel Pressure Control Device 7, FIGS. 3 and 4

Next referring to FIGS. 3 and 4, the construction of the intake air detecting device 7 will be described in detail. Reference numeral 36 denotes an air duct case made of aluminum by die-casting and provided with an air duct having a rectangular cross-sectional configuration and connected to an intake pipe (not shown); 37, a housing made of aluminum by die-casting; 38, a metallic diaphragm; 39, a case cover made of aluminum by die-casting as with the case of the case 36 and the housing 37; 40, a shaft of the sensor valve; 41, a fuel metering cylindrical bearing; and 42, a bearing for supporting the shaft 42. Both the bearings 41 and 42 are made of Cr-Mo steel. The shaft 40 is inserted into the fuel metering cylindrical bearing 41 and the sensor valve shaft bearing 42 so as to be smoothly rotated. Reference numeral 43 denotes a fuel passage of the sensor valve shaft 40; 44, a cutout portion of the sensor valve shaft 40; 45, a fuel feed port of the fuel metering cylindrical bearing 41, 46, a parallel slit formed in the fuel metering cylindrical bearing 41 in the circumferential direction thereof; 47, a fuel discharge port; 48, a lower chamber defined by the case 36 and the metallic diaphragm 38 within the fuel differential pressure regulating valve 90; 49, an upper chamber defined by the housing 37 and the diaphragm 38 within the differential pressure regulating valve 90; 50, a return spring; and 51, a spring retainer. The spring retainer 51 is placed upon the metallic diaphragm 38 so that the return spring 50 exerts the load to the diaphragm 38. Reference numeral 52 denotes a fuel feed port; 53, a fuel supply passage; 54, a controlled pressure transmitting passage; 55, a fuel passage; and 56, a fuel discharge port. The fuel feed port 52 of the fuel pressure control device 7 is communicated with the fuel line 5*a* at the downstream of the orifice 6, and the controlled pressure transmitting passage 54 is connected to the fuel line 12 and communicated through the controlled pressure admitting port 18 with the pressure chamber 17 of the metering device 13. The fuel discharge port 56 is communicated with the fuel return line 9. Reference numeral 57 denotes a flap-shaped sensor valve made of Cr-Mo steel and carried by the sensor valve shaft 40 for rotation therewith; and 58, an arm fixed, at one end, to the sensor valve 57.

Figure 5:
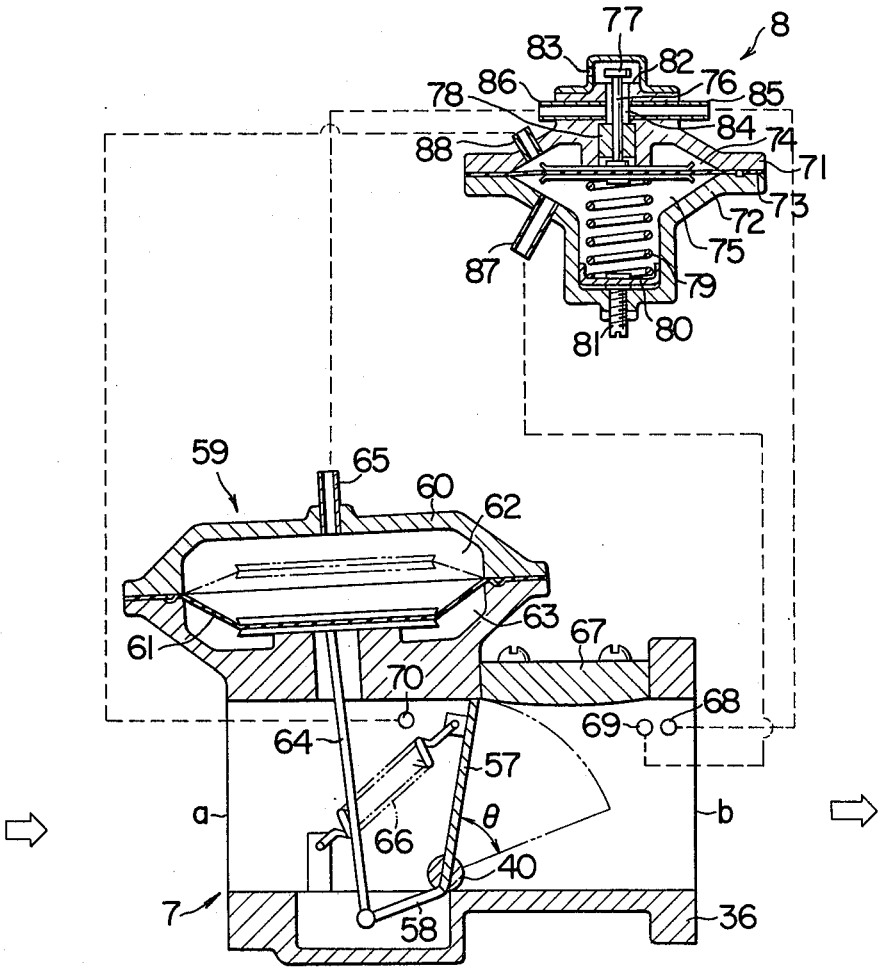
FIG. 5 is a cross sectional view taken along the line V—V of FIG. 3 with a differential pressure regulating valve being shown in cross-section.

Pressure-Activated Device 59, FIG. 5

Next referring to FIG. 5, the pressure-activated device 59 will be described. In FIG. 5, reference numeral 60 denotes a housing; 61, a diaphragm made of a resilient material such as rubber; 62, an upper chamber defined by the housing 60 and the diaphragm 61; 63, a lower chamber similar to the upper chamber 62; 64, a connecting rod interconnecting between the diaphragm 61 and the arm 58 for imparting the turning force to the sensor valve 57; 65, a negative pressure admitting port in communication with the upper chamber 62; 66, a return spring for the sensor valve 57; 67, a compensation plate attached to the case 36 said compensation plate compensating the intake air passage area as a function of $\sin^2(\theta/2)$ where $\theta$ is an angle of rotation of the sensor valve shaft 40 and further the compensation plate 67 having a smooth bulging surface; 68 and 69, negative pressure admitting ports opened at the downstream of the sensor valve 57; and 70, a negative pressure admitting port opened at the upstream of the sensor valve 57.

Still referring to FIG. 5, the intake air differential pressure regulating valve or regulator 8 will be described in detail hereinafter. Reference numerals 71 and 72 denote housing; 73, a diaphragm; 74 and 75, negative pressure chambers defined by the housing 71 and the diaphragm 73; 76, a sliding shaft fixed to the diaphragm 73; 77, a control valve; 78, a bearing; 79, a return spring; 80, a spring retainer; 71, an adjusting screw for presetting the force of the return spring 79; 82, a valve seat formed at the upper surface of the housing 71; 83, an air intake port; 84, an air passage; 85, a negative pressure admitting port in communication with the negative pressure admitting port 68; 86, a negative pressure admitting port in communication with the negative pressure admitting port 65; 87, a negative pressure admitting port in communication with the negative pressure admitting port 69; and 88, a negative pressure admitting port in communication with the negative pressure admitting port 70.

Mode of Operation

Next referring to FIGS. 1 through 5, the mode of operation of the first embodiment with the above construction will be described. When the engine E is started, the intake air passages through an air cleaner (not shown) and the fuel pressure control device 7 in the direction from the upstream side *a* to the downstream side *b* thereof and flows into an intake pipe (not shown) of the engine E. When the intake air passes through the control device 7, its dynamic pressure acts on the sensor valve so that the sensor valve shaft 40 is rotated against the return spring 66 through an angle which is dependent upon the intake air volume or flow rate of intake air. The rotation of the sensor valve shaft 40 is caused by the air acting upon the sensor valve 57 and by the force of the negative pressure which is transmitted from the negative pressure admitting port 68 through the differential pressure regulating valve 8 and acts on the upper surface of the diaphragm 61 in the pressure-activated device 59. The latter force is transmitted through the connecting rod 64 fixed to the diaphragm 61. Meanwhile the pressures at the upstream and downstream of the sensor valve 57 are transmitted through the negative pressure admitting ports 70 and 69 to the negative pressure chambers 74 and 75 of the intake air differential pressure regulating valve 8 so that the sliding shaft 76 of the differential pressure regulating valve 8 is displaced under the differential pressure across the sensor valve 57 and the force of the return spring 79. In this case, a variable orifice is defined between the control valve 77 and the flat valve seat 82, and the air with the atmospheric pressure flows from the air intake port 83 through this variable orifice, reducing the negative pressure acting upon the upper surface of the diaphragm 61 of the pressure activated device 59 (See FIG. 5), whereby the sensor valve 57 is displaced in the direction in which the air duct in the fuel pressure control device 7 is closed. The above described operation is accomplished over the whole range of intake air quantity. Therefore the intake air differential pressure regulating valve 8 as well as the pressure-activated device 59 always maintains the differential pressure across the sensor valve 57 constant. The area of the intake air passage defined by the sensor valve 57 and the compensation plate 67 varies as a function of $\sin^2(\theta/2)$, where $\theta$ is the angle of rotation of the sensor valve shaft 40 because the smooth bulging surface of the compensation plate 67 is so formed that the area of the intake air passage may vary as a function of $\sin^2(\theta/2)$, where $\theta$ is the angle of rotation of the sensor valve 57. Therefore, the quantity of air passing through the fuel pressure control device 7 varies as a function of $\sin^2(\theta/2)$ where $\theta$ is the angle of rotation of the sensor valve shaft 40 whenever the variation in discharge coefficient is negligible.

Next the flow of the fuel will be described. The fuel is pumped up by the fuel pump 2 from the fuel tank, and the fuel flow whose pressure is maintained at a constant pressure level by the regulator 3 is divided into a first and second flows which pass through the lines 5*a* and 5*b,* respectively. The excess fuel is returned through the return pipe 4 to the fuel tank 1. The fuel flows through the fixed orifice 6 and the fuel feed port 52 of the fuel pressure control device 7 into the lower chamber 48 of the fuel differential pressure regulating valve 90, acting upon the undersurface of the diaphragm 39. Thereafter the fuel flows through the fuel feed passage 53, the fuel intake port 45 and the fuel passage 43 to the cutout portion 44 of the sensor valve shaft 40. The fuel is metered by the control orifice between the parallel slit 46 and the cutout portion 44, the area of opening of the control orifice being varied as a function of $\sin^2(\theta/2)$, where $\theta$ is the angle of rotation of the sensor valve shaft 40. Thereafter, the fuel flows through the fuel discharge port 47 and the fuel passage 55 into the upper chamber 49 of the differential pressure regulating valve 90, acting upon the metallic diaphragm 38. Thereafter the fuel is returned to the fuel tank 1 through the fuel discharge port 56, the line 9, the fixed orifice 10 and the line 11. This return flow is controlled by an opening area defined between the lower end of the fuel discharge or outlet port 56 and the metallic diaphragm 38 so that the desired differential pressure across the metallic diaphragm 38 may be maintained over the whole range of the fuel pressure by the equilibrium between the pressure difference across the metallic diaphragm 38 and the force of the return spring 50.

The fuel in the lower chamber 48 of the fuel differential pressure regulating valve 90 flows also through the controlled pressure transmitting passage 54 and the line 12 to the controlled pressure intake port 18 of the fuel metering device 13, and then flows into the pressure chamber 17, exerting its controlled pressure to the left end face of the control shaft 16 through the communication passage 7*a.* The control shaft 16 is displaced and rests at a position where the equilibrium between the controlled pressure and the force of the return spring 19 is attained. That is, the displacement of the control shaft 16 varies in linear relation with the controlled pressure. Next descriptions will be concerning the controlled pressure of the fuel. The maximum quantity of the fuel passing through the fixed orifice 6 and the parallel slit 46 of the fuel passage control device 7 are limited. The fuel pressure at the upstream of the fixed orifice 6 is maintained constant by the regulator 3 while the differential pressure across the parallel slit 46 is always maintained constant as described before. Therefore, the pressure of the fuel before it flows into the parallel slit 46; that is, the controlled pressure transmitted to the pressure chamber 17 changes in proportion to the square of the opening area of the parallel slit 46. As the result, the controlled pressure changes as a function of $\sin^2(\theta/2)$, where $\theta$ is the rotating angle of the sensor valve shaft 40, since the opening area of the parallel slit 46 varies as a function of $\sin^2(\theta/2)$.

Because of the reasons previously described, the quantity of intake air varies as a function of $\sin^2(\theta/2)$ where $\theta$ is the angle of rotation of the sensor valve shaft 40. The controlled pressure exerting upon the control shaft 16 also varies as a function of $\sin^2(\theta/2)$. Furthermore, the displacement of the control shaft 16 and the controlled pressure vary at the ratio of 1:1. As a result, the displacement of the control shaft 16 is completely in linear proportion to the quantity of intake air. Lastly, the fuel to be delivered to the internal combustion engine E will be described. The fuel which is pumped up by the fuel pump and whose pressure is maintained at a constant level by the regulator 3 flows into the fuel intake port (not shown) radially extending through the housing 14 of the fuel metering device 13 through the fuel line 5*b,* and then flows through the annular groove 22 and the fuel intake port 31 of the control shaft 16 into the fuel passage 30. The fuel which has flown into the fuel passage 30 flows through the fuel discharge port 33 into the annular grove 32 of the control shaft 16, and then flows continuously into the distribution chamber 28 through the slit 29 of the rotor 15. The fuel which has flown into the distribution chamber 28 flows successively into the respective fuel intake ports 23A, 23B, 23C and 23D of the housing 14 when the distribution chamber 28 of the rotor 15 is communicated with the respective fuel intake port depending upon the angular position of the rotor 15. (That is, the fuel flows successively into the respective fuel outlets or discharge ports 21A, 21B, 21C and 21D of the housing 14). The rotor 15 makes one rotation for every two rotations of the internal combustion engine E, the fuel is supplied once to each fuel discharge port 21A, 21B, 21C or 21D of the housing 14 for every two rotations of the internal combustion engine E. In case of the four-cycle internal combustion engine, two rotations make one cycle so that the fuel is injected at a suitable stroke of each engine cyclinder into each branch of the intake manifold or duct connected to the each cylinder of the internal combustion engine E, and the injected fuel is charged into the respective cylinders. The fuel is intermittently injected for each cylinder. As described before, the control shaft is displaced relatively to the rotor 15 depending upon the controlled pressure so that the variable-area orifice or the area of overlapping between the slit 29 of the rotor 15 and the annular groove 32 of the control shaft 16 varies accordingly. As a result, the fuel which is distributed in the manner described above is correctly metered in response to the quantity of the intake air inducted into the engine.

Figure 6:
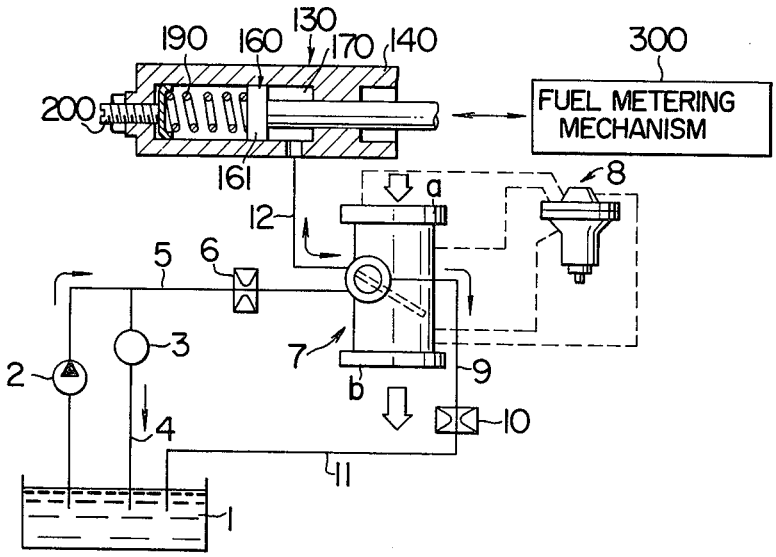
FIG. 6 is a block diagram of a second embodiment of the present invention.

The present invention shall not be limited to the first embodiment described above. For instance, as shown in FIG. 6, a fuel metering device 130 may comprises a housing 140 and a spring-loaded control shaft 160 fitted into the housing 140 for slidable movement therein and loaded with a spring 190, the flange portion 161 of the control shaft 160 and the housing 140 defining a pressure chamber 170. In response to the reciprocal movement of the control shaft 160, a fuel metering mechanism 300 for metering and distributing the fuel to be delivered to the respective fuel injection nozzles (not shown) may be actuated.

So far the present invention may be described in conjunction with the intermittent fuel injection system, but it is to be understood that it may be also applied to a continuous fuel injection system. In the latter system, the fuel metering mechanism 300 is replaced with a conventional mechanism of the type consisting of a sleeve and a valve, and the piston (or plunger) and the control shaft are drivingly coupled or they are formed integral as a unitary construction.

What is claimed is:

1. A fuel injection system for a multi-cylinder type internal combustion engine comprising:

a. fuel delivery means for regulating the pressure of fuel at a predetermined level and delivering fuel as a first and a second flows;

b. fuel pressure control means for changing the pressure of the first fuel flow delivered from said fuel delivery means in response to the quantity of intake air inducted into the engine, said fuel pressure control means comprising i. a housing having an intake air passage adapted to be connected to an intake pipe of the engine, ii. a sensor valve disposed in said intake air passage, the rotating angle of said sensor valve being in proportion to the quantity of intake air passing through said intake air passage, iii. a sensor valve shaft connected to said sensor valve for rotation in unison therewith, said sensor valve shaft having a cutout portion formed at a part thereof, iv. a fuel metering cylindrical bearing, disposed in said housing, for supporting said sensor valve shaft and provided with a fine parallel slit which defines with said cutout portion of the sensor valve shaft a control orifice, v. a fuel differential pressure regulating valve for maintaining the pressure across said control orifice substantially at a predetermined level, vi. a first fuel passage for delivering the fuel from said fuel delivery means to said control orifice and said fuel differential pressure regulating valve, vii. a second fuel passage for admitting to the exterior of the fuel pressure control means the fuel pressure at the upstream of said control orifice, viii. compensation means disposed within said intake air passage in said housing in the proximity of said sensor valve for compensating the sectional area of said intake air passage, and ix. pressure-activated means operatively coupled to said sensor valve for maintaining the differential pressure across said sensor valve at a predetermined level;

c. fuel metering means for metering and distributing the second fuel flow from said fuel delivery means in response to the controlled pressure of the fuel from the outlet of said fuel pressure control means, said fuel metering means comprising i. a housing having a plurality of fuel intake ports equal in number to the cylinders of the engine, ii. a rotor disposed in said housing and adapted to be operatively coupled to said engine for rotation in synchronism with the crankshaft of said engine, said rotor having a slit which, upon rotation of said rotor, intermittently and sequentially communicate with said fuel intake ports of said housing, iii. a control shaft axially slidably fitted into said rotor, said control shaft being provided with an annular groove which normally communicates with said slit of said rotor with an opening area, said opening area varying in response to the axial displacement of said control shaft, iv. a pressure chamber formed within said housing so that the controlled pressure of the fuel in said pressure chamber may be transmitted to said control shaft, said pressure chamber being in communication with said second fuel passage of said fuel pressure control means, and v. a fuel passage for delivering the fuel of said second flow from said fuel delivery means to said annular groove of said control shaft; and d. a plurality of fuel injection nozzles equal in number to the cylinders of said engine, said fuel injection nozzles respectively communicate with said fuel intake ports of said fuel metering means for injecting and delivering the metered fuel into said engine.

2. A fuel injection system as set forth in claim 1, wherein said control shaft is biased by a return spring.

3. A fuel injection system as set forth in claim 1, wherein said rotor is so arranged as to make one rotation for every two rotations of said crankshaft.

4. A fuel injection system as set forth in claim 1, wherein said housing of said fuel metering means is in the form of a cylinder, and said fuel intake ports are located substantially at the same axial position and circumferentially equiangularly spaced apart from each other.

5. A fuel injection system for an internal combustion engine comprising:

a fuel delivery means for regulating the pressure of fuel at a predetermined level and delivering fuel as first and second flows, said fuel delivery means comprising i. a fuel tank for storing the fuel therein, ii. a fuel pump for pressurizing and delivering the fuel from said fuel tank, iii. a regulator for returning a portion of the fuel delivered from said fuel delivered from said fuel pump to said fuel tank, and iv. a fixed orifice for limiting the maximum fuel flow rate of the first flow;

b. fuel pressure means for changing the pressure of the first fuel flow delivered from said fuel delivery means in response to the quantity of intake air inducted into the engine, said fuel pressure control means comprising i. a housing having an intake air passage rectangular in cross section, adapted to be connected to an intake pipe of the engine, ii. a sensor valve disposed in said intake air passage, the rotating angle $\theta$ of said sensor valve being in proportion to the quantity of intake air passing through said intake air passage, iii. a sensor valvve shaft connected to said sensor valve for rotation in unison with therewith, said sensor valve shaft having a cutout portion formed at a part thereof, iv. a fuel metering cylindrical bearing disposed in said housing and provided with a fine parallel slit which defines with said cutout portion of said sensor valve shaft a control orifice whose opening area varies as a function of $\sin^2(\theta/2)$ where $\theta$ is the rotating angle of the sensor valve shaft, v. a fuel differential pressure regulating valve for maintaining the pressure across said control orifice substantially at a predetermined level, vi. a first fuel passage for delivering the fuel from said first delivery means to said control orifice and said fuel differential pressure regulating valve, vii. a return line for returning the excess fuel from said fuel differential pressure regulating valve to said fuel tank, viii. a second fuel passage for admitting to the exterior of the fuel pressure control means the fuel pressure at the upstream of said control orifice, ix. compensation means disposed within said intake air passage in said housing in the proximity of said sensor valve, for compensating the sectional area of said intake air passage so that said sectional area varies as a function of $\sin^2(\theta/2)$ where $\theta$ is the rotating angle of the sensor valve shaft, and x. pressure activated means operatively coupled to said sensor valve for maintaining the differential pressure across said sensor valve at a predetermined level;

c. fuel metering means for metering and distributing the second fuel flow from said fuel delivery means in response to the controlled pressure of the fuel from the outlet of said fuel control means, said fuel metering means comprising i. a housing having a plurality of fuel intake ports equal in number to the cylinders of the engine, ii. a rotor disposed in said housing and adapted to be operatively coupled to the engine for rotation in synchronism with the crankshaft thereof, said rotor having a slit which, upon rotation of said rotor, interittently and sequentially communicate with said respective fuel intake ports of said housing, iii. a control shaft axially slidably fitted into said rotor in said housing and operatively coupled to said rotor, said control shaft being provided with a groove which, together with said slit of said rotor, defines a variable orifice for metering the fuel, whose opening area varies in response to the axial displacement of said control shaft, iv. a pressure chamber formed in said housing so that the pressure of the fuel in said pressure chamber may be transmitted to said control shaft so as to control the axial displacement thereof, said pressure chamber being in communication with said second fuel passage of said fuel pressure control means, and v. a fuel passage for delivering the fuel of said second flow from said fuel delivery means to said groove of said control shaft; and d. a plurality of fuel injection nozzle equal in number to the cylinders of the engine, and said fuel injection nozzles respectively communicate with said fuel intake ports of said fuel metering means for injecting and delivering the metered fuel into the engine.

6. A fuel injection system for an internal combustion engine comprising:

a. fuel delivery mens for regulating the pressure of fuel at a predetermined level and delivering fuel as a first and a second fuel flows;

b. a fuel pressure control means for changing the pressure of the first fuel flow delivered from said fuel delivery means in response to the quantity of intake air inducted into the engine, said fuel pressure control means comprising i. a housing having an intake air passage adapted to be connected to an intake pipe of the engine, ii. a sensor valve disposed in said intake air passage, the rotating angle of said sensor valve being in proportion to the quantity of intake air passing through said intake air passage, iii. a sensor valve shaft connected to said sensor valve for rotation in unison therewith, said sensor valve shaft having a cutout portion formed at a part thereof, iv. a fuel metering bearing, disposed in said housing, for supporting said sensor valve shaft and provided with a fine parallel slit which defines with said cutout portion of the sensor valve shaft a control orifice, v. a fuel differential pressure regulating valve for maintaining the pressure across said control orifice substantially at a predetermined level, vi. a first fuel passage for delivering the fuel from said fuel delivery means to said control orifice and said fuel differential pressure regulating valve.

vii. a second fuel passage for admitting to the exterior of the fuel pressure control means the fuel pressure at the upstream of said control orifice, viii. compensation means disposed within said intake air passage in said housing in the proximity of said sensor valve for compensating the sectional area of said intake air passage, and ix. pressure-activated means operatively coupled to said sensor valve for maintaining the differential pressure across said sensor valve at a predetermined level;

c. fuel metering means for metering and distributing the second fuel flow from said fuel delivery means in response to the controlled pressure of the fuel from the outlet of said fuel pressure control means, said fuel metering means comprising i. a housing ii. a control shaft axially slidably disposed within said housing, iii. a pressure chamber in communication with said second fuel passage of said fuel pressure control means, said pressure chamber being adapted for transitting the pressure of the fuel in said pressure chamber to said control shaft, and iv. a fuel metering mechanism for metering and distributing the fuel in response to the axial displacement of said control shaft; and d. a plurality of fuel injection nozzle equals in number to the cylinders of the engine for injection and delivering the fuel metered by said fuel metering mechanism into said engine.

7. A fuel injection system as set forth in claim 6, wherein a return spring is loaded between said sensor valve and said housing of said fuel pressure control means, for normally biasing said sensor valve in the direction in which said sensor valve is closed.

8. A fuel injection system as set forth in claim 6, wherein said fuel metering means has a return spring which normally biases said control shaft in the direction opposite to the direction in which the pressure of the fuel is exerted to said control shaft.

9. A fuel injection system as set forth in claim 6, wherein said pressure-activated means comprising i. a diaphragm operatively coupled to said sensor valve, ii. a housing in which said diaphragm is disposed so as to define an upper chamber and a lower chamber above and below respectively; and iii. a negative pressure admitting port for transmitting a negative pressure into one of said upper and lower chambers.

10. A fuel injection system as set forth in claim 9, wherein said pressure-activated means includes an intake air differential pressure regulating valve for controlling pressure regulating valve for controlling the negative pressure to be transmitted to said one of said upper and lower chambers, said intake air differential pressure regulating valve comprising, i. a housing, ii. a diaphragm disposed in said housing, thereby defining two pressure chambers above and below of said diaphragm within said housing, iii. a first negative pressure admitting port (87) formed in said housing for transmitting the air pressure signal at the downstream of said sensor valve in said intake air pressure of said fuel pressure control means to one of said two pressure chambers, iv. a second negative pressure admitting port (88) formed in said housing for transmitting the air pressure signal at the upstream of said sensor valve into the other one of said two pressure chamber, v. a spring disposed in said one of two pressure chambers for biasing said diaphragm, vi. a third negative pressure admitting port (85) formed in said housing and opened at the downstream of said sensor valve in said intake air passage, vii. a negative pressure discharge port (86) formed in said housing and communicated to said third negative pressure admitting port, said negative pressure discharge port being opened at the upstream of said sensor valve in said intake air pressure, viii. an air intake port (83) in communication with said negative pressure discharge port for admitting atmospheric pressure, ix. a valve body (77) and a valve seat (72) interposed between said negative pressure discharge port and said air intake port, constituting a variable orifice, and x. a shaft for interconnecting said valve body and said diaphragm.

* * * * *